US007215298B1

(12) United States Patent
Fraschilla et al.

(10) Patent No.: US 7,215,298 B1
(45) Date of Patent: May 8, 2007

(54) EXTENDABLE/RETRACTABLE ANTENNA CALIBRATION ELEMENT

(75) Inventors: John Fraschilla, Hainesport, NJ (US); Robert M. Reese, Mt. Laurel, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/219,978

(22) Filed: Sep. 6, 2005

(51) Int. Cl.
*H01Q 1/50* (2006.01)

(52) U.S. Cl. ..... 343/853; 343/700 MS; 342/174; 342/368

(58) Field of Classification Search ..... 343/700 MS, 343/776, 853, 895; 342/174, 360, 368
See application file for complete search history.

(56) References Cited

U.S. PATENT DOCUMENTS 5,248,982 A * 9/1993 Reinhardt et al. ..... 342/375
5,477,229 A * 12/1995 Caille et al. ..... 342/360
6,157,343 A * 12/2000 Andersson et al. ..... 342/371
6,636,173 B2 * 10/2003 Graham ..... 342/174
6,771,216 B2 * 8/2004 Patel et al. ..... 342/368
7,132,979 B2 * 11/2006 Langenberg ..... 342/368

* cited by examiner

*Primary Examiner*—Tho Phan
(74) *Attorney, Agent, or Firm*—Duane Morris, LLP

(57) ABSTRACT

An antenna array coacts with a ground plane for radiation. Calibration of the array is accomplished with the aid of one or more extensible calibration antenna elements, such as monopole antenna elements. Each calibration monopole is ordinarily retracted below the ground plane and is not "energized." When calibration is desired, it is extended to protrude above the ground plane so as to achieve mutual coupling with one or more of the elements of the array antenna. Calibration signals may be passed in either direction. The calibration antenna may be extended/retracted by vacuum, mechanical device, or electrical motor.

17 Claims, 4 Drawing Sheets

EXTENDABLE/RETRACTABLE ANTENNA CALIBRATION ELEMENT

GOVERNMENTAL INTEREST

This invention was made with government support under Contract/Grant SBAR 1TL405P01T11. The United States Government has a non-exclusive, non-transferable, paid-up license in this invention.

FIELD OF THE INVENTION

This invention relates to antennas and arrays thereof, and more particularly to the calibration of antennas and arrays of antennas by means of retractable and extendable elements.

BACKGROUND OF THE INVENTION

Antennas are widely used for remote sensing, communications, and for industrial/therapeutic purposes. An antenna is simply a transducer between guided and unguided electromagnetic fields. An antenna, seen as a transducer, includes a "feed" port and a "radiating aperture" unguided or free-space radiation port. The feed port is so termed for historical reasons; early receiving antennas were simply pieces of electrically conductive wire which received little attention, while transmitting antennas received sophisticated attention because of the great effect that they could have on the high-power transmitters of the age. Thus, antennas were originally viewed as being transmitting devices defining one or more feed points. Only later was it discovered that antennas have the same radiation patterns and other characteristics in both the transmitting and receiving modes of operation. The feed port is ordinarily coupled to a "transmission line," which is simply an electrical conducting arrangement having a defined (or at least controlled) surge or characteristic impedance. The electromagnetic energy flowing in the transmission line is guided by the line, and the radiation at the free-space port is in directions controlled by the "electrical field distribution" at the radiating aperture of the antenna. When the antenna operates in a receiving mode, free-space or unguided energy impinging thereon is transduced to become guided energy in the transmission line, and in the transmitting mode, guided energy applied to the feed port from the transmission line is radiated as unguided radiation (subject to certain limitations).

The field distribution characteristics of the radiating aperture of an antenna determine the "far-field" radiation pattern. One of the salient generalizations which can be made about antennas is that the radiating beam width is inversely related to the dimensions of the radiating aperture. That is, a highly directive antenna or radiation beam (a beam subtending a small sector of space) requires a large radiating aperture in terms of wavelength, and conversely a small radiating aperture results in a low-directivity or broad radiation beam. There are two popular ways to achieve a large radiating aperture in order to form directive antenna beams, namely (a) reflectors and (b) arrays.

An antenna array is an array including a plurality of antennas. When antennas are arrayed and properly phased, the overall radiation pattern is determined as the result of an "array factor" which multiplies the radiation pattern of the underlying antenna element of the array. Array antennas are of two general types, namely line (one-dimensional) arrays and surface (two-dimensional) arrays. The salient difference between these two is that the line array produces an array factor which multiplies the pattern of the underlying array only in the direction of the array, while a surface array produces a useful array factor in two mutually orthogonal directions. Thus, when a three-dimensional "pencil" beam is desired, it is likely that a two-dimensional surface array will be required. A plurality of line arrays can be juxtapositioned and fed so as to form a surface array, and a surface array can be viewed as being a plurality of interconnected line arrays.

As mentioned, it is necessary to feed the elements of an array antenna with signals of controlled phase in order to achieve the desired radiation pattern. The distribution of signals from a common feed point to the individual antenna elements of the array is often accomplished by a beamformer, which divides the available signal among the antenna elements, and which may include a phase shifter associated with each antenna element, or at least with subgroups of antenna element. The phase shifters are controlled in well-known manner in order to achieve the desired antenna beam direction. Each antenna element (or subgroup of antenna elements) of an array antenna may be associated with controllable attenuators and amplifiers as well as with phase shifters. In order to route the signals between and among the antenna elements, their amplifiers, phase shifters, and attenuators, if any, and possibly other elements, the array antenna will also include transmission lines. These transmission lines may take the form of hollow conductive waveguides, coaxial transmission lines, andor any one of various forms of "printed-circuit" transmission lines, such as finline, stripline or microstrip, all known in the art. Each transmission line must maintain its proper impedance to prevent the introduction of unwanted phase shifts andor attenuation, and remain electrically connected to its signal source and load.

Considering the complexity of array antennas, and all the potential problems which can arise due to degradation or failure of one or more of the amplifiers, phase shifters, attenuators, and transmission lines, it may be desirable to provide for some means for calibrating the antenna array in order to allow monitoring of its condition. One way to calibrate an array antenna is to compare it with a standard antenna, such as a horn antenna. That is, a source is coupled to the array and then to the horn, and the radiated power or energy at a substantial distance (the "far field") in a particular direction is determined for each. The difference between the two represents the "gain" difference. As mentioned, this technique is quite suitable to a laboratory, but may not be easy to accomplish where the array is installed or located.

Another way to calibrate an antenna is to mount a test or calibration antenna near the antenna to be tested. Such calibrations are often known as "near-field" calibrations, and have the advantage of improved signal-to-noise ratio over the far-field technique. Signals are transmitted between the antenna being tested and the test/calibration antenna. Such a technique is described in U.S. Pat. No. 6,084,545, issued Jul. 4, 2000 in the name of Lier et al. In this patent, a calibration antenna or probe is placed in front of the array antenna to be tested, and the test signals are transmitted from the probe to the antenna being tested in the receive mode or from the antenna being tested to the probe in the transmit mode.

Another calibration method is described in U.S. Pat. No. 6,356,233, issued Mar. 12, 2002 in the name of Miller et al. This arrangement deems certain antenna elements of the antenna under test to be "kernel" elements, and uses mutual coupling between the kernel elements and the remainder of the antenna elements of the array to determine characteristics of the antenna. A system of switches and directional couplers routes test signals through the various kernel elements and their mutually coupled array elements.

Improved array antenna calibration arrangements are desired.

SUMMARY OF THE INVENTION

An antenna arrangement according to an aspect of the invention comprises an electrically conductive ground sheet defining at least a first broad side, and possibly a second broad side. A principal antenna arrangement or "principal antenna" is provided for at least one of transmitting and receiving. The principal antenna arrangement coacts with the conductive ground sheet for transducing electromagnetic signals flowing in space in that half-space adjacent to, or facing the first broad side of the ground sheet. The ground sheet may be flat, curved or generally nonplanar. The principal antenna includes at least one principal antenna port accessible from the other half-space remote from the first broad side of the ground sheet. The antenna arrangement also includes a retractable/extensible calibration radiation or antenna element, which may be a monopole, capable of mechanically extending through the first broad side of the ground sheet, and also being capable of assuming (a) a retracted position in which the calibration radiation or antenna element is retracted below the first broad side of the ground sheet (that is, having no part extending into the half-space adjacent the first broad side of the ground sheet) and (b) an extended position in which the calibration radiation or antenna element extends from the first side of the ground sheet into the adjacent half-space. A calibration antenna feed port is associated with the calibration radiation or antenna element. A calibration arrangement may be coupled to the calibration antenna feed port and to the at least one port of the principal antenna, for applying signals to one of (a) at least a portion of the principal antenna and (b) the calibration radiation or antenna element, for causing signals to flow between the calibration radiation or antenna element and the principal antenna. This signal flow may be in either direction.

In a particular embodiment of the invention, the principal antenna is an array antenna including a beamformer to which the principal antenna port is coupled. In this particular embodiment, the array antenna may be (a) an array of electromagnetic radiators, each of which is flush with the first side of the ground sheet, (b) an array of horn aperture elements, (c) an array of patch antenna elements.

In a particular hypostasis of the invention, the principal antenna is an array of antenna elements, each of which extends into the half-space. Such antennas may include axial-mode helical antennas.

In another hypostasis, the principal antenna is an array of antenna elements, each of which has a radiating aperture which is flush with the local portion of the first side of the ground sheet. The antenna elements may be monolithic, printed-circuit or patch antennas, or they may be horn antennas.

DESCRIPTION OF THE INVENTION

Figure 1:
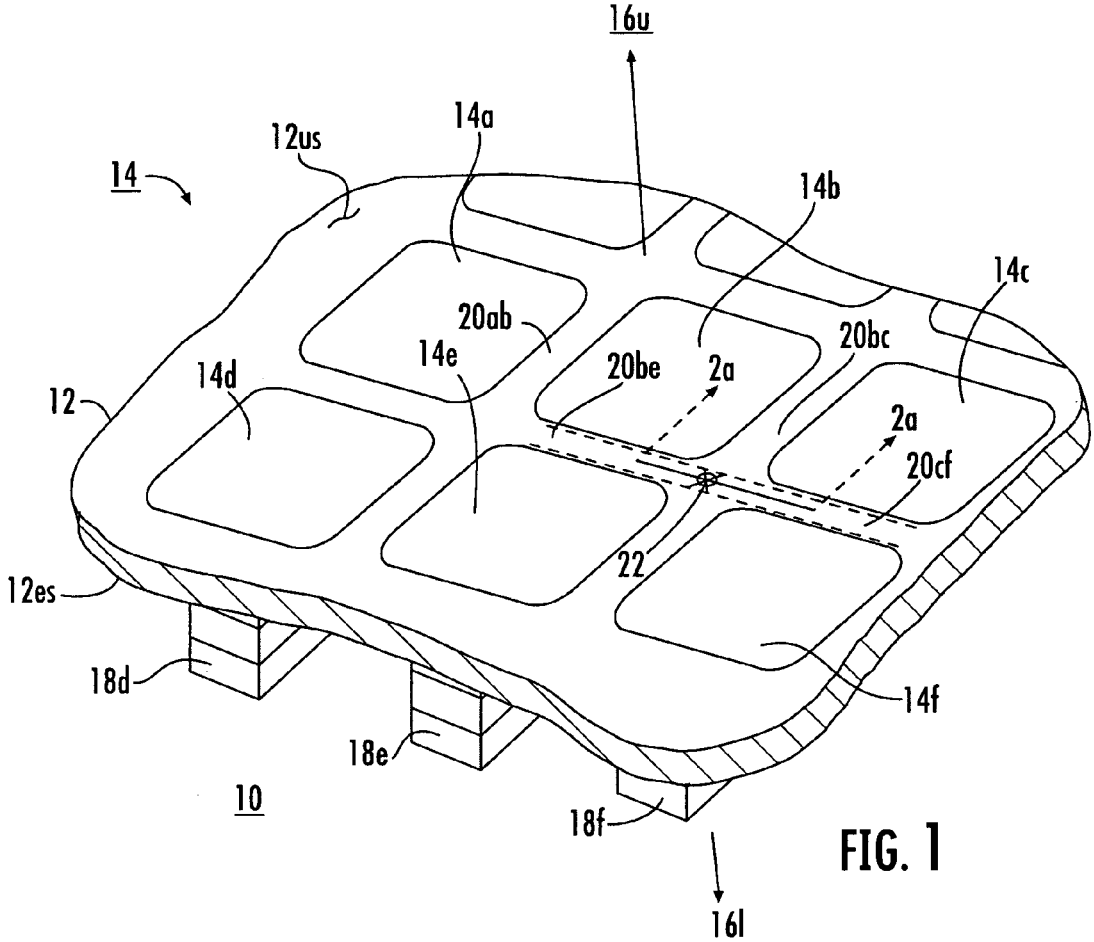
FIG. 1 is a simplified perspective or isometric view of a portion of an array antenna including a conductive ground plane, a plurality of antenna elements, and an extendible/retractable calibration antenna shown in its retracted position.

In FIG. 1, antenna arrangement 10 includes a portion of an array antenna 14. Antenna arrangement 10 includes a generally planar electrically conductive ground plane, ground conductor or sheet 12, and a plurality of individual antenna elements of the array, illustrated as a set 14 of generally rectangular radiating apertures (array antenna elements) 14*a*, 14*b*, 14*c*, 14*d*, 14*e*, and 14*f* facing a half-universe or half-space 16*u* lying "above" upper surface 12*us* of ground plane 12. Such radiating apertures transduce electromagnetic energy between the antenna element and half-space 16*u*. For definiteness, the radiating antenna elements are assumed to be rectangular horns including tapered electrically-conductive hollow waveguide structures designated generally as 18 extending into the lower half-space 16*l* lying "below" conductive ground plane 12. Thus, structure 18*d* represents the waveguide horn structure associated with radiating aperture 14*d*, structure 18*e* represents the waveguide horn or feed structure associated with radiating aperture 14*e*, and structure 18*f* represents the waveguide horn structure associated with radiating aperture 14*f*. The waveguide horn structure includes the "feed" for the associated antenna element. As illustrated in FIG. 1, no details of the horn structure of the set 14 if antenna elements are shown. This may be viewed as being attributable to an electromagnetically transparent or dielectric "radome" overlying each radiating aperture of set 14 of radiating apertures, each flush with upper surface 12*us* of ground plane 12.

The description herein includes relative placement or orientation words such as "top," "bottom," "up," "down," "lower," "upper," "horizontal," "vertical," "above," "below," as well as derivative terms such as "horizontally," "downwardly," and the like. These and other terms should be understood as to refer to the orientation or position then being described, or illustrated in the drawing(s), and not to the orientation or position of the actual element(s) being described or illustrated. These terms are used for convenience in description and understanding, and do not require that the apparatus be constructed or operated in the described position or orientation.

Terms concerning mechanical attachments, couplings, and the like, such as "connected," "attached," "mounted," refer to relationships in which structures are secured or attached to one another either directly or indirectly through intervening structures, as well as both movable and rigid attachments or relationships, unless expressly described otherwise.

In FIG. 1, a "ridge" portion of the ground plane 12 lies between each mutually adjacent pair of radiating apertures of set 14. In FIG. 1, that ridge portion of the ground plane lying between radiating apertures 14*a* and 14*b* is designated 20*ab*, that ridge portion lying between apertures 14*b* and 14*c* is designated 20*bc*, and that ridge portion lying between radiating apertures 14*b* and 14*e* is designated 20*be*.

According to an aspect of the invention, a retractable and extensible calibration element 22 is mounted at a location designated 22 in FIG. 1, at the junction of ground plane 12 ridge portions 20*be*, 20*bc*, and 20*cf*. The selected location for calibration element 22 provides substantial coupling or mutual coupling between the calibration antenna 22 and the four adjacent radiating apertures 14*b*, 14*c*, 14*e*, and 14*f* of the set 14 of radiating apertures (antenna elements) of the array. Depending upon the characteristics of the calibration element 22 and the antenna elements of array 10, each calibration element may provide significant coupling to antenna elements more remote than the four immediately adjacent apertures or antenna elements. It is contemplated that a plurality of calibration elements will be associated with each array antenna, with the locations of the calibration antennas being selected to provide suitable coupling to a set or subset of the array antenna elements.

Figure 2:
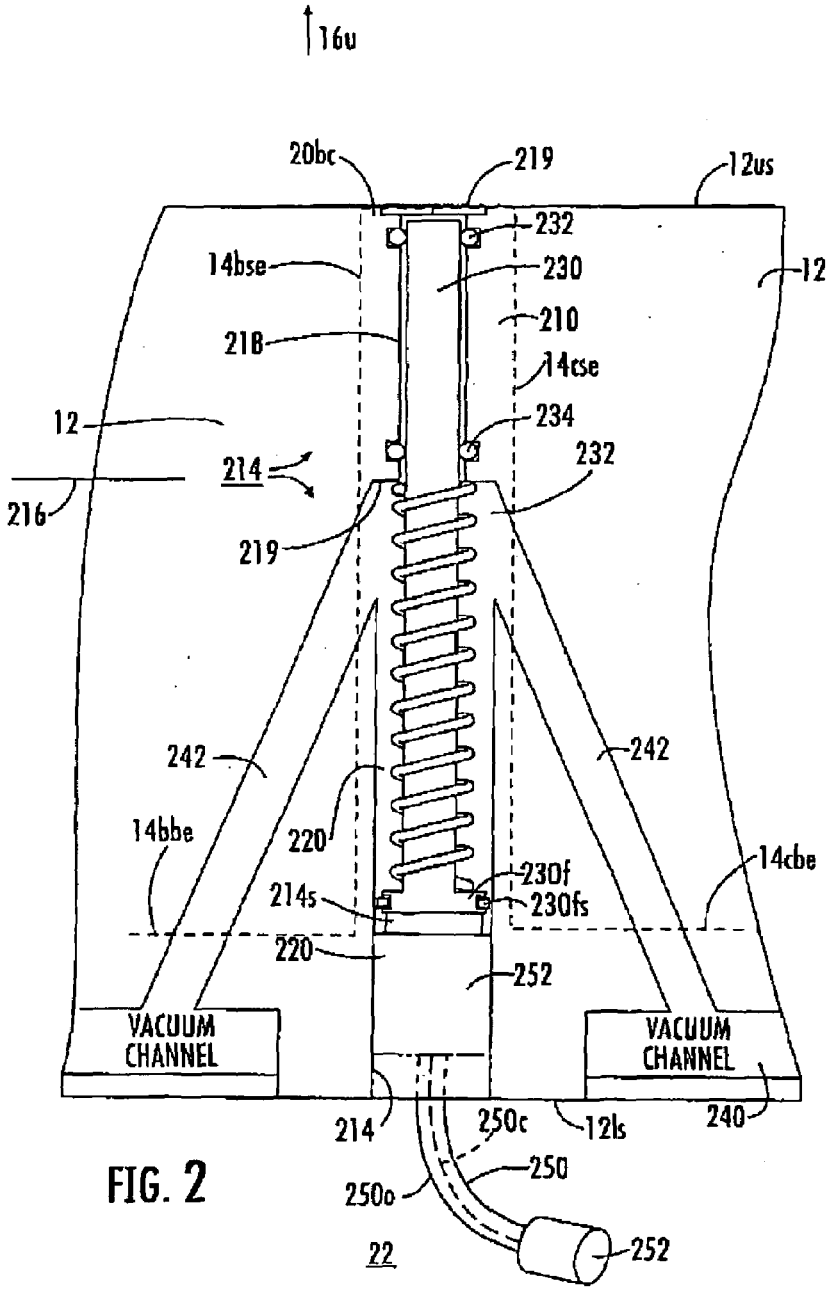
FIG. 2 is a simplified cross-sectional view of the structure of FIG. 1 in the region of the calibration antenna, with the calibration antenna in its retracted position.

FIG. 2 is a simplified cross-sectional view of retractable and extensible calibration antenna element 22 of FIG. 1 in its retracted position. In FIG. 2, electrically conductive ground plate or sheet 12 defines a lower surface 12*ls*. Side and bottom edges of the cavity of horn element 14*b* are illustrated as dash lines 14*se* and 14*bbe*, respectively, side and bottom edges of the cavity of horn element 14*c* are illustrated as dash lines 14*cse* and 14*cbe*, respectively. A stepped bore designated generally as 214 extends through ground plane 12. Stepped bore 214 includes a first, relatively small-diameter portion 218 extending from the upper surface of ground plane 12 to a transverse plane 216, and a second, larger-diameter portion 220 extending from plane 216 to lower surface 12*ls* of ground sheet 12. An elastomeric weatherseal 219 protects the upper end of bore 218. An electrically conductive rod or monopole 230 extends through portions of bores 216 and 218, and is supported away from the walls of bore 218 by a pair of elastic O-rings 232 and 234, which also tend to prevent dirt or unwanted matter from leaking into the interior of the calibration antenna arrangement. The bottom of monopole 230 defines an enlarged flange 230*f*, which, in the illustrated retracted position, bears against an inwardly-projecting ridge or collar 214*s* of the large portion 220 of bore 214, and is prevented thereby from retracting to a lower position. In the retracted position of the calibration antenna, the contact of flange 230*f* with the ridge or collar 214*s* of bore 214 tends to "ground" the feed end of the calibration antenna monopole 230, and to thereby prevent effective feeding of the calibration antenna, thereby tending to prevent unwanted calibration signal leakage. An electrically nonconductive stow spring 232 bears at its upper end against the step 219 between the small-diameter bore portion 218 and the large-diameter bore portion 220, and at its lower end against flange 230*f*, and urges the rod or monopole 230 toward the illustrated stowed position. Flange 230*f* bears a circumferential electrically nonconductive seal 230*fs* which bears against the walls of bore portion 220 of stepped bore 214, to provide an axially movable seal against leakage of fluid such as air, and to maintain the calibration monopole antenna 230 centered in the bore.

One or more vacuum channels 240 extend through portions of block 12 to a remote control location (not illustrated). At the remote control location, vacuum can be selectively applied to or removed from (that is, returned to atmospheric pressure) the various vacuum channels, for control of the extension or state of the rod 230 of monopole calibration element 22. More particularly, the various vacuum channels 240 to which vacuum is selectively applied communicate by way of slant channels, two of which are illustrated as 242, with that portion of large portion 220 of bore 214 lying immediately below step 219. Application of vacuum to the various channels 240 results in application of vacuum to the upper side of flange 230*f*. The pressure difference between the atmospheric pressure applied to the lower side of flange 230*f* and the vacuum applied to the upper side results in an upwardly-directed force which is sufficient to overcome the downwardly-directed force of stow spring 232, with the result that the rod or monopole element 230 tends to rise or move upward toward the extended position. The extended position is reached when stow spring 232 is fully compressed.

A coaxial feed transmission line or "cable" 250, including a center conductor 250*c* and an outer conductor 250*o*, is coupled by way a connector arrangement 252 to the bottom end of monopole element 230. More particularly, the center conductor 250*c* of cable 250 is electrically connected to the flange 230*f*, and the outer conductor 250*o* is electrically connected, by means of electrically conductive springs (not illustrated) to the surrounding electrically conductive bore and to conductive ground sheet 12. Electrical isolation is maintained between flange 230*f* and outer conductor 250*o* of coaxial feed cable 250.

Figure 3:
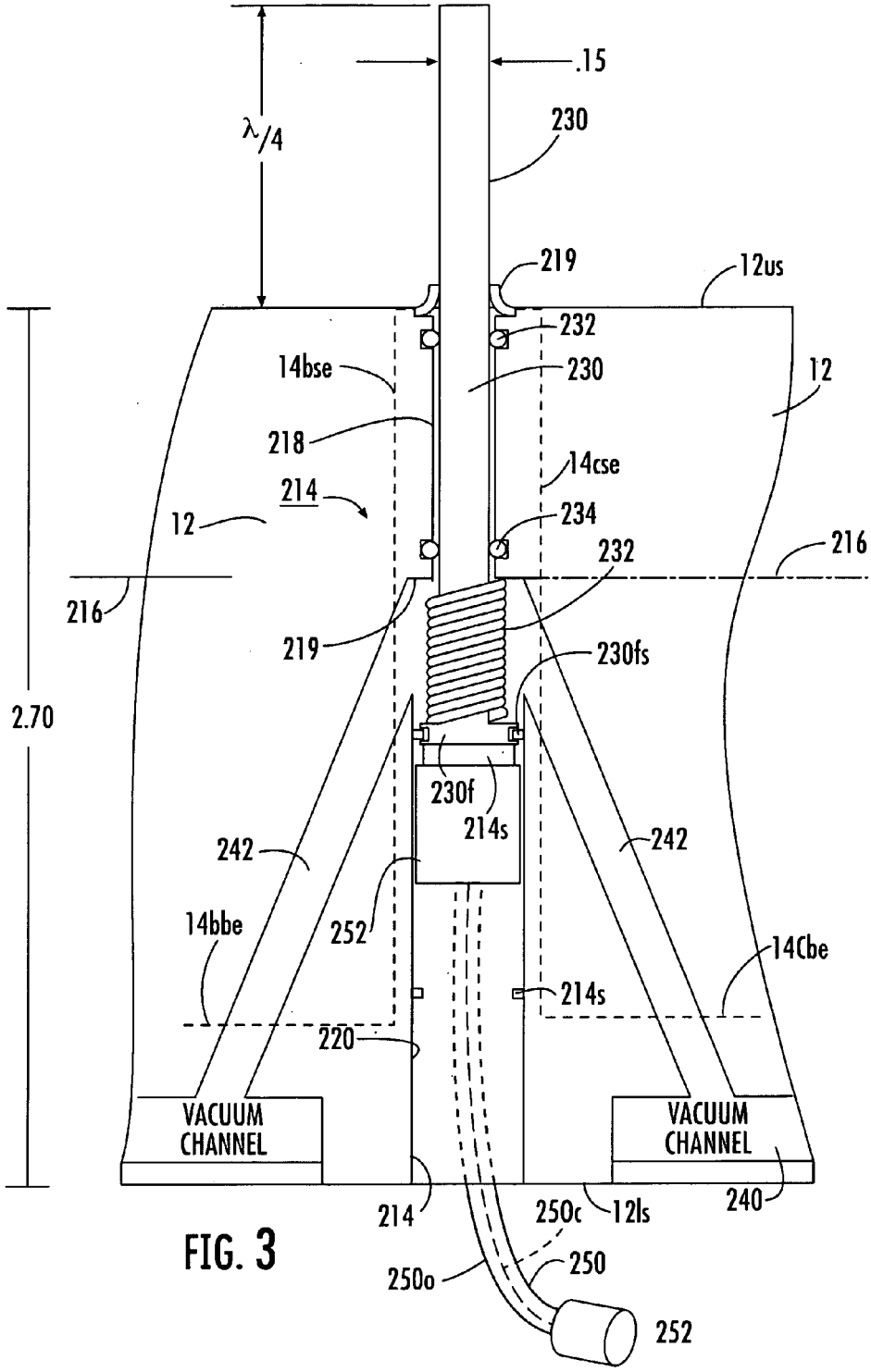
FIG. 3 is a simplified cross-sectional view of the structure of FIG. 2 in its extended position.

Application of vacuum to vacuum channels 240 and slant channels 242 of FIG. 2 results in extension of the monopole calibration antenna element 230, to a position illustrated in FIG. 3. As illustrated in FIG. 3, application of vacuum by way of the vacuum channels 240 and 242 to the bore 214 and the upper surface of flange 230*f*, sealed by flange seal 230*fs*, creates forces which oppose the force of stow spring 232. As a result, the calibration antenna monopole 230 rises until the stow spring 230 is fully compressed and the distal end of the calibration antenna monopole 230 extends above the plane of the upper surface 12*us* of the ground plane 12. In the illustrated embodiment, the projection is one-quarter free-space wavelength ($\lambda/4$).

Once the calibration antenna 230 (and any other calibration antennas which may be present) are extended by application of vacuum to their respective vacuum ports, calibration signals may be passed by mutual coupling between the antenna of the antenna array and the calibration antennas. As an alternative, the calibration antennas may be extended individually, with the other calibration antennas retracted, so as to minimize the effects of mutual coupling between the extended calibration antennas themselves.

More particularly, signals may be applied to the extended calibration antenna 230 for reception by one or more of the array antenna elements, such as nearby array antenna elements 14*b*, 14*c*, 14*e*, and 14*f* of FIG. 1. Depending upon how many array antenna elements are associated with each calibration monopole antenna, calibration signals may be transmitted in either direction between the calibration monopole antenna and any number of array antenna elements, individually or as groups or subgroups.

Figure 4:
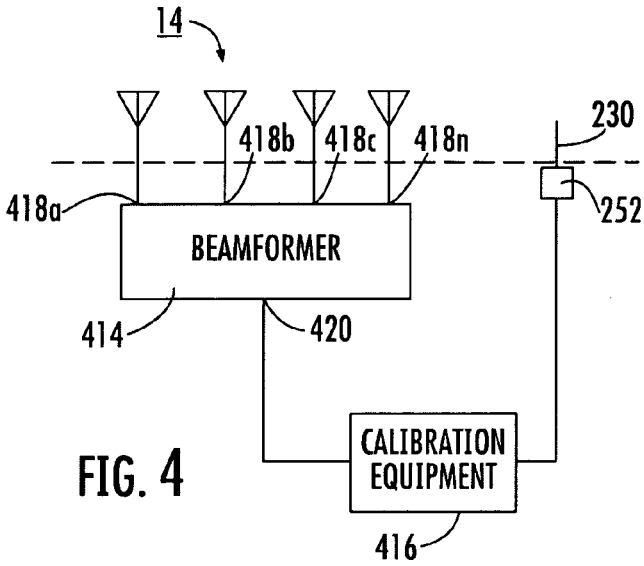
FIG. 4 is a simplified block diagram of an array antenna and a calibration monopole antenna according to an aspect of the invention, in which the array antenna is associated with a beamformer and a calibration device is coupled to the array and the calibration monopole.

FIG. 4 illustrates an array 14 of symbolic antenna elements, which are connected to the antenna ports 418*a*, 418*b*, 418*c*, . . . , 418*n* of a beamformer 414. The (or possibly a) common beamformer port 420 feeds a subgroup or all of the antennas of array 14. Common port 420 is connected to a calibration device 416. Calibration device 416 is also connected at a feed port 252 to calibration monopole antenna element 230. Calibration device 416 measures the coupling magnitude andor phase between the calibration monopole antenna element 230 and the group of antenna elements of array 14, or possibly subgroups or individual elements of the array, depending upon the connections available in beamformer 414. Naturally, if there are additional calibration monopole antenna elements equivalent to 230, it is connected to them, too, as by selection switches. It will seldom be necessary to determine the mutual coupling between one calibration monopole antenna element and another.

Figure 5:
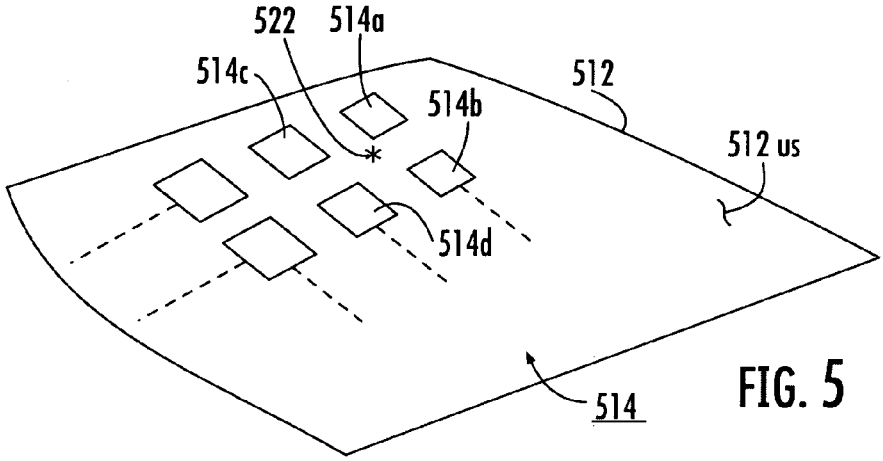
FIG. 5 is a simplified illustration of the radiating side of a patch antenna array.

FIG. 5 illustrates an array 514 of patch antenna elements including coplanar conductive patches 514*a*, 514*b*, 514*c*, and 514*d* mounted on a support 512. Those skilled in the art know that such patch antennas must be electrically isolated from ground in most applications, so the upper surface 512*us* of support 512 cannot be electrically conductive. However, such patch antenna arrays are often associated with a ground plane which lies below the upper surface 512*us* of support 512. A calibration monopole antenna element can be associated with this "hidden" ground plane. A possible location for a calibration monopole antenna element is indicated as 522.

Figure 6:
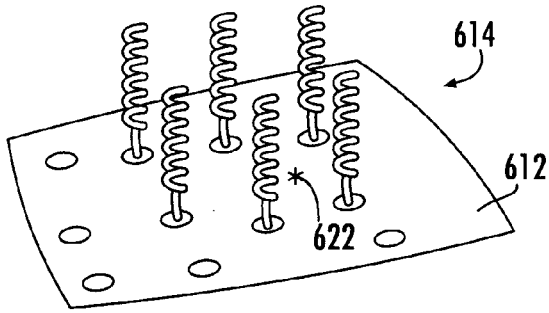
FIG. 6 is a simplified illustration of the radiating side of an antenna array where the array elements project into the half-space.

FIG. 6 illustrates a portion of an array 614 of helical antennas, which may be axial-mode helical antennas. As known to those skilled in the antenna arts, such antennas are fed "against" ground 612, so that the feed is isolated from ground plane 612. As illustrated, each feed point is associated with an aperture in the ground plane 612. Each aperture may be connected to the outer conductor of a coaxial cable, as known, and the center conductor of the coaxial cable can be connected to the bottom of the helical element. A possible location for a calibration monopole antenna element is indicated as 622.

While the extension of the calibration monopole antenna as described uses vacuum power, any type of extension/retraction mechanism could be used. For example, an electrically powered motor similar to those used for automobile monopole antennas could be used instead of a vacuum/spring mechanism. If desired, a manually-operated mechanical device, such as a handwheel-operated gear arrangement, could also be used to raise and lower the calibration antenna. Those skilled in the antenna arts know that various types of end loading could be used with the monopole, as for example a capacitive top cap, which could retract into a correspondingly dimensioned aperture in the ground plane.

An antenna arrangement (10) according to an aspect of the invention comprises an electrically conductive ground sheet (12) defining a first (12*us*), and possibly a second (12*ls*) broad side. A principal antenna arrangement (array 14) or "principal antenna" is provided for at least one of transmitting and receiving. The principal antenna arrangement (14) coacts with the conductive ground sheet (12) for transducing electromagnetic signals flowing in space in that half-space (16*u*) adjacent to, or facing, the first broad side (12*us*) of the ground sheet (12). The ground sheet may be flat, curved or generally nonplanar. The principal antenna (14) includes at least one principal antenna port (18*d*, 18*e*) accessible from that half-space remote from the first broad side of the ground sheet (12). The antenna arrangement (10) also includes a retractable or retractable/extensible calibration radiation element or antenna (230), which may be a monopole, capable of mechanically extending through the first side (12*us*) of the ground sheet (12), and also being capable of assuming (a) a retracted position (FIG. 2) in which the monopole calibration antenna element (230) is retracted, possibly completely retracted, below the first side (12*us*) of the ground sheet (12), which is to say that it has no part extending into the upper half-space 16*u*, and (b) an extended position (FIG. 3) in which the calibration radiation element or antenna (230) extends from the first side (12*us*) of the ground sheet (12) into the half-space (16*u*). A calibration radiation element or antenna feed port (252) is associated with the calibration radiation or antenna element (230). A calibration arrangement may be coupled to the calibration antenna feed port (252) and to the at least one port (18*d*, 18*e*) of the principal antenna (14), for applying signals to one of (a) at least a portion of the principal antenna (14) and (b) the calibration radiation or antenna element (230), for causing signals to flow between the calibration radiation or antenna element and the principal antenna.

In a particular embodiment of the invention, the principal antenna (14) is an array antenna including a beamformer (514) to which the principal antenna port (418*a*, 418*b*, . . . 418*n*)) is coupled. In this particular embodiment, the array antenna (14) may be (a) an array of electromagnetic radiators, each of which is flush with the first side (12*us*) of the ground sheet (120, (b) an array of horn aperture elements, or (c) an array (514) of patch antenna elements (514*a*, 514*b*, 514*c*, 514*d*, . . . .)

In a particular hypostasis of the invention, the principal antenna (614) is an array of antenna elements, each of which extends into the half-space. Such antennas may include helical antennas, including axial-mode helical antennas.

In another hypostasis, the principal antenna is an array of antenna elements, each of which has a radiating aperture which is flush with the local portion of the first side of the ground sheet. The antenna elements may be monolithic, printed-circuit or patch antennas (FIG. 5), or they may be horn antennas (FIG. 1).

What is claimed is:

1. An antenna arrangement, comprising:

a conductive ground sheet defining at least a first broad side;

a principal antenna for at least one of transmitting and receiving, said principal antenna arrangement coacting with said conductive ground sheet for transducing electromagnetic signals flowing in space in that half-space adjacent said first broad side of said ground sheet, said principal antenna including at least one principal antenna port;

a retractable-extensible calibration radiation element capable of extending through at least said first broad side of said ground sheet, and also being capable of assuming (a) a retracted position in which said calibration radiation element does not extend into said half-space and (b) an extended position in which said calibration radiation element extends from said first side of said ground sheet into said half-space; and a calibration antenna port associated with said calibration radiation element.

2. An antenna arrangement according to claim 1, wherein said calibration radiation element is a monopole.

3. An antenna arrangement according to claim 1, further comprising:

a calibration arrangement coupled to said calibration radiation element port and to said at least one port of said principal antenna, for applying signals to one of (a) at least a portion of said principal antenna and (b) said calibration radiation element, for causing signals to flow between said calibration radiation element and said principal antenna.

4. An antenna arrangement according to claim 1, wherein said principal antenna port of said principal antenna is accessible from the other half-space associated with said ground sheet.

5. An antenna arrangement according to claim 1, wherein:

said principal antenna is an array antenna including a beamformer to which said principal antenna port is coupled.

6. An antenna arrangement according to claim 5, wherein:

said array antenna is an array of electromagnetic radiators, each of which is flush with said first side of said ground sheet.

7. An antenna according to claim 6, wherein:

said array antenna is an array of horn aperture elements.

8. An antenna arrangement according to claim 6, wherein:

said array antenna is an array of patch antenna elements.

9. An antenna arrangement according to claim 1, wherein:

said principal antenna is an array of antenna elements, each of which extends into said half-space.

10. An antenna arrangement according to claim 9, wherein:

said array of antenna elements includes axial-mode helical antennas.

11. An antenna arrangement according to claim 9, wherein:

said array of antenna elements includes an array of individual antenna elements, each of which has a radiating aperture which is flush with the local portion of the first broad surface of the ground sheet.

12. An antenna arrangement according to claim 11, wherein said individual antenna elements are patch antennas.

13. An antenna arrangement according to claim 11, wherein said individual antenna elements are horn antennas.

14. An antenna according to claim 1, wherein said first side of said ground sheet is flat.

15. An antenna arrangement according to claim 1, wherein said calibration radiation element comprises an electrically conductive monopole element which, in said extended position, is electrically insulated from said ground sheet.

16. An antenna according to claim 15, wherein the length of said calibration radiation element is one-quarter wavelength at the calibration frequency.

17. An antenna arrangement, comprising:

a conductive ground sheet defining at least a first broad side;

a principal antenna for at least one of transmitting and receiving, said principal antenna arrangement coacting with said conductive ground sheet for transducing electromagnetic signals flowing in space in that half-space adjacent said first broad side of said ground sheet, said principal antenna including at least one principal antenna port;

a retractable-extensible monopole calibration element capable of extending through at least said first broad side of said ground sheet, and also being capable of assuming (a) a retracted position in which said calibration element does not extend into said half-space and (b) an extended position in which said calibration element extends from said first broad side of said ground sheet into said half-space; and a calibration antenna port associated with said calibration element.

* * * * *